US005389942A

United States Patent [19]

Oglesby, Jr.

[11] Patent Number: 5,389,942

[45] Date of Patent: Feb. 14, 1995

[54] ANTENNA MOUNT COVER

[76] Inventor: Charles E. Oglesby, Jr., 602 E. Tantallon Dr., Fort Washington, Md. 20744

[21] Appl. No.: 133,840

[22] Filed: Oct. 12, 1993

[51] Int. Cl.[6] ..... H01Q 1/42

[52] U.S. Cl. ..... 343/872; 343/711; 343/713; 343/715; 343/873; 343/878; 343/888; 343/889; 343/900; 343/905; 248/206.5

[58] Field of Search ..... 343/702, 705, 709, 711, 343/713, 715, 872, 873, 878, 888, 889, 900, 905; 248/345.1, 206.5, 683; H01Q 1/42

[56] References Cited

U.S. PATENT DOCUMENTS

| | | | |
|---|---|---|---|
| 2,206,821 | 7/1940 | Mydlil | 343/888 |
| 2,496,601 | 2/1950 | Schamblin | 343/715 |
| 3,369,247 | 2/1968 | Bacon | 343/888 |
| 4,134,121 | 1/1979 | Northcutt | 343/715 |
| 4,173,761 | 11/1979 | Liautaud | 343/888 X |
| 4,218,684 | 8/1980 | Northcutt | 343/715 |
| 4,543,584 | 9/1985 | Leer | 343/715 X |
| 4,918,459 | 4/1990 | De Teso | 343/872 |
| 5,031,874 | 7/1991 | Shannon | 248/683 |

FOREIGN PATENT DOCUMENTS

| | | | |
|---|---|---|---|
| 447509 | 3/1948 | Canada | 343/715 |

*Primary Examiner*—Donald Hajec
*Assistant Examiner*—Steven Wigmore
*Attorney, Agent, or Firm*—Richard C. Litman

[57] ABSTRACT

A cover for the base element of a magnetically mounted vehicle antenna in the form of a bag having a closure is provided to protect the finish of a vehicle's surface from blemishes due to repeated removal or placement of the magnetic mount and movement caused by high vehicular speeds. Various types of closure are provided for the cover bag such as a snap, zipper, hook and loop fastener, elastic banding, drawstring or combinations thereof. The cover may be made from cloth or a leathery material or a combination thereof. The cover bag may be colored for aesthetic and/or protective reasons.

9 Claims, 2 Drawing Sheets

ANTENNA MOUNT COVER

BACKGROUND OF THE INVENTION

1. Field of the Invention

The present invention relates to a novel cover for the base of magnetically adhered cellular phone and citizen band radio antennas for vehicles wherein protection from inclement weather and dirt accumulation is accomplished.

Use of magnetically adhered vehicle antennas invariably results in scarring of the vehicle finish as a result of frequent mounting and/or movement of the antenna base during travel. There is a need to protect the painted finish from blemishes caused by the magnetic mount.

2. Description of the Prior Art

U.S. Pat. No. 3,369,247 issued to Mitchell L. Bacow on Feb. 13, 1968 discloses a radio antenna mounting bracket for vehicles which includes an anti-scratch pad for the clip mount portion and a protective strip grommet for the base bottom. No disclosure for a top cover is present.

U.S. Pat. No. 4,134,121 issued to William Northcutt on Jan. 9, 1979 discloses a three-part plastic cover permanently mounted over the base of a trunk or roof mounted antenna which is permanently attached. There is a plastic or rubber mounting pad having a central opening under the base. The plastic cover functions as a security cover and protection against dust, dirt and the elements. The cover is distinguished because it is permanently mounted and does not protect the vehicle's painted finish. There is no provision for portable means for this antenna.

U.S. Pat. No. 4,218,684 issued to William Northcutt of Aug. 19, 1980 discloses a permanently attached security cover for a trunk or roof mounted antenna consisting of a base pad, a base cover, a top cover which fits inside said base cover, and a rubber or plastic base pad having a central opening. This plastic cover and base pad combination is distinguished for similar reasons attributed to the inventor's prior patent.

Canadian Pat. No. 447,509 issued to Donald L. Hings on Mar. 30, 1948 discloses whip antennas permanently attached at both ends on a vehicle. Both mounted bases include an insulating plate contacting the vehicle. There is no provision of a base cover.

None of the above inventions and patents, taken either singly or in combination, is seen to describe the instant invention as claimed.

SUMMARY OF THE INVENTION

By the present invention, an improved base cover for a magnetically adhered vehicle antenna is disclosed.

Accordingly , one of the objects of the present invention is to provide a water repellant cover for a magnetic mount which will cover the entire base in order to protect the finish of the vehicle upon which is mounted.

Still another object of the invention is to provide a cover which may be readily replaced when deteriorated or worn.

A further object of the present invention is to provide a cover which has closure means to prevent precipitation from entering the bag from above. The closure means may comprise either snap, hook and loop fastener, zipper, drawstring, elastic banding or any combination thereof.

Another object of the present invention is to provide a bag cover comprising a cloth or leathery material or a combination thereof.

Yet another object of the present invention is to provide an opening near the base of the bag cover for entry of the coaxial cable attached to the antenna base.

A final object of the present invention is to provide a bag cover having either a solid color or a colored pattern. The color may have a reflecting property.

These and other objects of the present invention will become readily apparent upon further review of the following specification and drawing.

BRIEF DESCRIPTION OF THE DRAWINGS

The drawings are isometric views of the bag cover protecting the base portion of an antenna for a vehicle. The enclosed magnetic mount supports a radiator rod of either a cellular phone or citizen band radio antenna. The closure means illustrated in FIG. 1 is a combination of a zipper and a snap.

DETAILED DESCRIPTION OF THE PREFERRED EMBODIMENTS

The present invention comprises a novel bag covering the entire base portion of a magnetically adhered vehicle antenna in order to protect the surface upon which it is mounted. The novel bag permits additional advantages such as protection of the base from the elements and provision of aesthetic and safety advantages by virtue of coloring said bag.

The prior art discloses inflexible and permanently attached vehicle antennas. The antenna base is conventionally protected by a plastic or rubber ring portion. However, no unitary protective covering to protect the base from moving about on the finished vehicle surface and to protect the external surface of the base below the juncture of the antenna rod with the base portion has been clearly disclosed.

It is a known problem that magnetic mounts do damage the finish of a vehicle through repeated mounting or movement during travel at highway speeds.

Therefore, this novel covering bag could be utilized to solve the aforesaid problems encountered by the use of a magnetically adhered vehicle antenna. The bag could consist of any durable synthetic or natural fiber cloth with or without a further weather-proofing coating.

Figure 1:
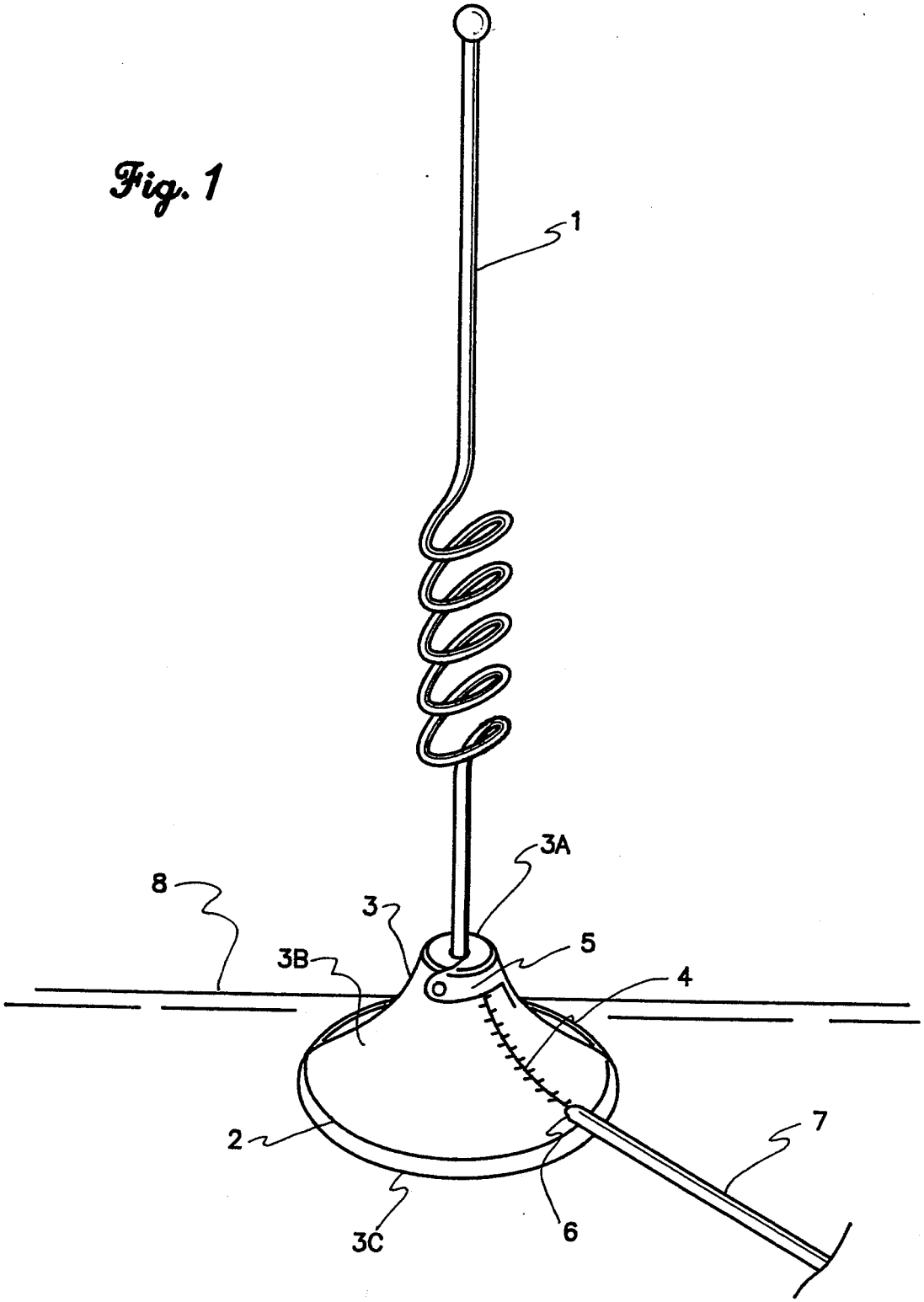

Referring to FIG. 1 of the drawings, 1 designates the radiator rod of a portable cellular phone or citizen band radio antenna, said rod extending from the base 2 which is enclosed in the novel base cover bag 3 made of flexible and water repellent material. The cover has top end 3A, side wall 3B joined to said top end, and bottom wall 3C which is peripherally connected to said side wall. This embodiment has a combination of zipper 4 combined with snap 5 with said bag having opening 6 for the access of the coaxial cable 7. The assembly rests on a painted surface 8.

Figure 2:
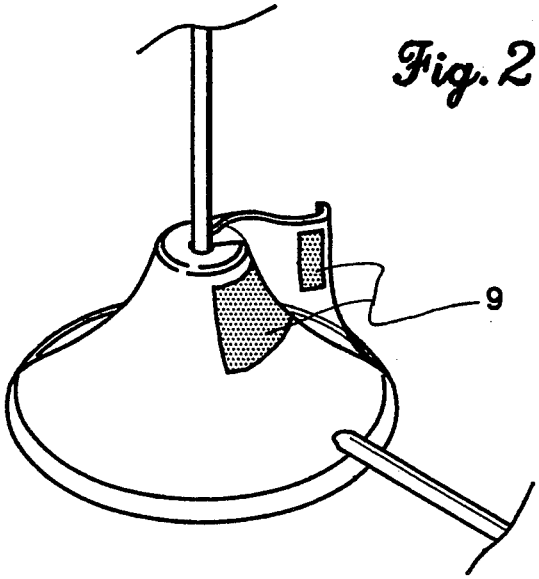
FIG. 2 illustrates hook and loop closure means 9.
Figure 3:
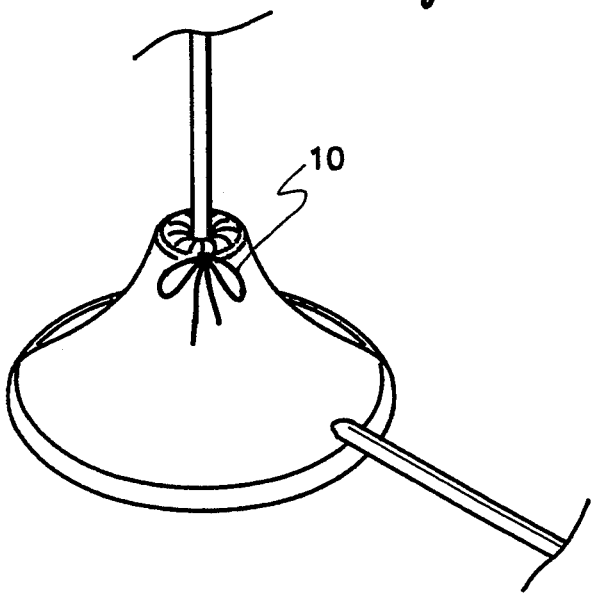
FIG. 3 illustrates drawstring closure means 10.
Figure 4:
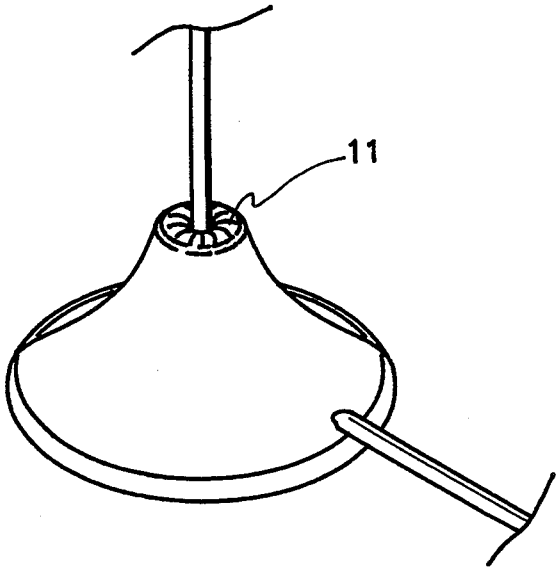
FIG. 4 illustrates elastic band closure means 11.

FIG. 2 illustrates hook and loop closure means 9. FIG. 3 illustrates drawstring closure means 10. FIG. 4 illustrates elastic band closure means 11.

The bag may be made from a cloth or leathery material or any combination such as a leathery top portion having a cloth bottom or vice-versa. The cloth may consist of either synthetic or natural fiber material. The cloth may further be rubberized or plasticized to increase its water repellency. The leathery material could be processed material such as patent leather or synthetic leather. The unprocessed leathery material could be natural leathers such as chamois.

The closure means 4 and 5 may comprise singular means or combinations as illustrated. Singular closure means include a zipper, a hook and loop fastener, a snap, a drawstring or an elastic band. Other combination closure means may comprise a hook and loop fastener at the side and a drawstring at the top of the cover bag. The closure means must be adequate to prevent excessive amounts of the elements to enter the bag and to prevent flapping of the bag at high vehicular speeds.

It is clear that if the coaxial cable could be disconnected at the base of the antenna, then the closure means need not extend from the coaxial cable opening, but could be positioned at the top of the cover bag.

It is to be understood that the present invention is not limited to the sole embodiment described above, but encompasses any and all embodiments within the scope of the following claims.

I claim:

1. A base cover for a magnetically adhered vehicle antenna having a radiator rod, a magnetic base and a coaxial cable connector fastened thereto, said base cover comprising:

a flexible bag structure made from water repellent material, said flexible bag structure enclosing the magnetic base and having a top end, a side wall joined to said top end, a bottom wall peripherally connected to said side wall;

means defining a first opening in said side wall adjacent said bottom wall, thereby enabling access of a coaxial cable connector to the magnetic base of the antenna;

means defining a second opening in said top end, thereby enabling said radiator rod to extend from space enclosed within said base cover to space exterior thereof; and releasable closure means disposed on said side wall of said flexible bag structure adjacent said top end for releaseably sealing said second opening of said base cover against said radiator rod.

2. The base cover according to claim 1, said closure means extending laterally along said side wall continuously from said top end to said second opening.

3. The base cover according to claim 1, wherein said water repellent material comprises cloth.

4. The base cover according to claim 1, wherein said water repellent material comprises leathery material.

5. The base cover according to claim 1, wherein said closure means includes a snap.

6. The base cover according to claim 1, wherein said closure means includes a zipper.

7. The base cover according to claim 1, wherein said closure means includes an elastic band.

8. The base cover according to claim 1, wherein said closure means includes a drawstring.

9. The base cover according to claim 1, wherein said closure means includes hook and loop fasteners.

* * * * *